US010854991B2

(12) United States Patent
Wong et al.

(10) Patent No.: US 10,854,991 B2
(45) Date of Patent: Dec. 1, 2020

(54) WAVEGUIDE FED OPEN SLOT ANTENNA

(71) Applicant: City University of Hong Kong, Kowloon (HK)

(72) Inventors: Hang Wong, Kowloon (HK); Xuan Yi, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 73 days.

(21) Appl. No.: 16/029,289

(22) Filed: Jul. 6, 2018

(65) Prior Publication Data

US 2020/0014118 A1 Jan. 9, 2020

(51) Int. Cl.

| | |
|---|---|
| ***H01Q 13/00*** | (2006.01) |
| ***H01Q 21/06*** | (2006.01) |
| ***H01Q 13/10*** | (2006.01) |
| ***H01Q 13/18*** | (2006.01) |

(52) U.S. Cl.
CPC ..... *H01Q 21/064* (2013.01); *H01Q 13/103* (2013.01); *H01Q 13/18* (2013.01)

(58) Field of Classification Search
CPC ..... H01Q 21/064; H01Q 13/103; H01Q 13/18
USPC ..... 343/771
See application file for complete search history.

(56) References Cited

U.S. PATENT DOCUMENTS 4,704,589 A * 11/1987 Moeller ..... H01P 5/182 333/113
5,541,612 A 7/1996 Josefsson
5,638,079 A 6/1997 Kastner et al.
5,831,583 A 11/1998 Lagerstedt et al.
9,368,878 B2 6/2016 Chen et al.
9,620,841 B2 * 4/2017 Tong ..... G01S 7/032
10,020,591 B2 * 7/2018 Uemichi ..... H01Q 21/0043
10,050,336 B2 * 8/2018 Wang ..... H01Q 1/28
(Continued)

FOREIGN PATENT DOCUMENTS

| | | |
|---|---|---|
| CN | 104092028 | 10/2014 |
| CN | 205004441 | 1/2016 |
| EP | 0440126 | 8/1991 |

OTHER PUBLICATIONS

Zhang et al., "Wideband Millimeter-Wave Substrate Integrated Waveguide Slotted Narrow-Wall Fed Cavity Antennas," IEEE Transactions on Antennas and Propagation, vol. 59, No. 5, pp. 1488-1496, May 2011, 9 pages.

(Continued)

*Primary Examiner* — Huedung X Mancuso
(74) *Attorney, Agent, or Firm* — Amin, Turocy & Watson, LLP

(57) ABSTRACT

The present disclosure relates to a waveguide fed open slot antenna. In some examples, the antenna comprises a waveguide section, a slot, a matching load, a waveguide bottom extension, and a vertical metal wall. The waveguide section can be in the form of a rectangular waveguide or a substrate integrated waveguide (SIW). The slot can comprise a rectangle, with one of its long sides abutting the top surface of the waveguide section, and another long side abutting the matching load, while the two short sides do not connect any metal. The waveguide bottom extension can be rectangular. The end of the waveguide bottom extension and the edge of the matching load on the side close to the open slot can be connected together by the vertical metal wall. In this way, the slot can be excited.

26 Claims, 11 Drawing Sheets

(56) References Cited

U.S. PATENT DOCUMENTS

| | | | | |
|---|---|---|---|---|
| 10,199,743 | B2 * | 2/2019 | Cheng | H01Q 21/062 |
| 10,299,368 | B2 * | 5/2019 | Huang | H01P 1/2088 |
| 10,522,919 | B2 * | 12/2019 | Pucci | H01Q 1/521 |
| 2009/0066597 | A1 | 3/2009 | Yang et al. | |

OTHER PUBLICATIONS

Gong et al., "Substrate Integrated Waveguide Cavity-Backed Wide Slot Antenna for 60-GHz Bands," Transactions on Antennas and Propagation, vol. 60, No. 12, pp. 6023-6026, Dec. 2012, 4 pages.
Guan et al., "An SIW Based Large-Scale Corporate-Feed Array Antenna," IEEE Transactions on Antennas and Propagation, vol. 63, No. 7, pp. 2969-2976, Jul. 2015, 8 pages.
Yang et al., "Wideband Millimeter-Wave Substrate Integrated Waveguide Cavity-Backed Rectangular Patch Antenna," IEEE Antennas and Wireless Propagation Letters, vol. 13, 2014, pp. 205-208, 4 pages.
Yan et al., "Simulation and Experiment on SIW Slot Array Antennas," IEEE Microwave and Wireless Components Letters, vol. 14, No. 9, Sep. 2004, pp. 446-448, 3 pages.
Ding et al., "A 4×4 Ridge Substrate Integrated Waveguide (RSIW) Slot Array Antenna," IEEE Antennas and Wireless Propagation Letters, vol. 8, 2009, pp. 561-564, 4 pages.
Chen et al., "Low-Cost High Gain Planar Antenna Array for 60-GHz Band Applications," IEEE Transactions on Antennas and Propagation, vol. 58, No. 6, Jun. 2010, pp. 2126-2129, 4 pages.
Mbaye et al., "Bandwidth Broadening of Dual-Slot Antenna Using Substrate Integrated Waveguide (SIW)" IEEE Antennas and Wireless Propagation Letters, vol. 12, 2013, pp. 1169-1171, 3 pages.
Miura et al., "Double-Layer Full-Corporate-Feed Hollow-Waveguide Slot Array Antenna in the 60-GHz Band," IEEE Transactions on Antennas and Propagation, vol. 59, No. 8, Aug. 2011, pp. 2844-2851, 8 pages.
Li et al., "Low-Cost High-Gain and Broadband Substrate- Integrated-Waveguide-Fed Patch Antenna Array for 60-GHz Band," IEEE Transactions on Antennas and Propagation, vol. 62, No. 11, Nov. 2014, pp. 5531-5538, 9 pages.
Zhu et al., "Substrate-Integrated-Waveguide-Fed Array Antenna Covering 57-71 GHz Band for 5G Applications," IEEE Transactions on Antennas and Propagation, vol. 65, No. 12, Dec. 2017, pp. 6298-6306, 9 pages.
Xu et al., "Bandwidth Enhancement for a 60 GHz Substrate Integrated Waveguide Fed Cavity Array Antenna on LTCC," IEEE Transactions on Antennas and Propagation, vol. 59, No. 3, Mar. 2011, pp. 826-832, 7 pages.
Li et al., "60-GHz Substrate Integrated Waveguide Fed Cavity-Backed Aperture-Coupled Microstrip Patch Antenna Arrays," IEEE Transactions on Antennas and Propagation, vol. 63, No. 3, Mar. 2015, pp. 1075-1085, 11 pages.

* cited by examiner

WAVEGUIDE FED OPEN SLOT ANTENNA

TECHNICAL FIELD

The subject disclosure generally relates to an antenna device in the field of communications, and in particular to a waveguide fed open slot antenna.

BACKGROUND

In wireless communication and radar systems, transmission and reception of signals rely on antennas. In recent years, various applications based on wireless technology have proliferated, both in microwave frequency bands and millimeter-wave frequency bands. However, the growing amount of wireless sub-systems on the same platform requires more antennas, which increases complexity and cost of the whole system. To solve this problem, many technologies have been proposed to develop wideband antennas with simple structure and low cost. However, such technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

FIG. 1(*b*) illustrates a top view of the example antenna of FIG. 1(*a*), in accordance with one or more embodiments described herein.

FIG. 1(*c*) illustrates a side view of the example antenna of FIG. 1(*a*), in accordance with one or more embodiments described herein.

FIG. 1(*d*) illustrates a bottom view of the example antenna of FIG. 1(*a*), in accordance with one or more embodiments described herein.

FIG. 3(*b*) illustrates a graph of simulated radiation patterns for the antenna of FIG. 1(*a*) at 74 GHz, in accordance with one or more embodiments described herein.

FIG. 3(*c*) illustrates a graph of simulated radiation patterns for the antenna of FIG. 1(*a*) at 94 GHz, in accordance with one or more embodiments described herein.

FIG. 4(*b*) illustrates an example antenna that utilizes a SIW as a waveguide section with a semi-circular metal patch as the matching load, in accordance with one or more embodiments described herein.

FIG. 4(*c*) illustrates an example antenna that utilizes a SIW as a waveguide section with a polygonal metal patch as the matching load, in accordance with one or more embodiments described herein.

FIG. 5(*b*) illustrates an example antenna that utilizes a SIW as the waveguide section, with the matching load comprising an upper metal patch, a bottom metal patch, and metalized vias, and where the metal patches are triangular, in accordance with one or more embodiments described herein.

FIG. 5(*c*) illustrates an example antenna that utilizes a SIW as the waveguide section, with the matching load comprising an upper metal patch, a bottom metal patch, and metalized vias, and where the metal patches are semi-circular, in accordance with one or more embodiments described herein.

FIG. 5(*d*) illustrates an example antenna that utilizes a SIW as the waveguide section, with the matching load comprising an upper metal patch, a bottom metal patch, and metalized vias, and where the metal patches are polygonal, in accordance with one or more embodiments described herein.

FIG. 6(*b*) illustrates an example antenna that utilizes a rectangular waveguide as the waveguide section with a triangular metal patch as the matching load, in accordance with one or more embodiments described herein.

FIG. 6(*c*) illustrates an example antenna that utilizes a rectangular waveguide as the waveguide section with a semi-circular metal patch as the matching load, in accordance with one or more embodiments described herein.

FIG. 6(*d*) illustrates an example antenna that utilizes a rectangular waveguide as the waveguide section, with a polygonal metal patch as the matching load, in accordance with one or more embodiments described herein.

FIG. 7(*b*) illustrates an example antenna that utilizes a rectangular waveguide as the waveguide section with a triangular metal block as the matching load, in accordance with one or more embodiments described herein.

FIG. 7(*c*) illustrates an example antenna that utilizes a rectangular waveguide as the waveguide section with a semi-circular metal block as the matching load, in accordance with one or more embodiments described herein.

FIG. 7(*d*) illustrates an example an antenna that utilizes a rectangular waveguide as the waveguide section with a polygonal metal block as the matching load, in accordance with one or more embodiments described herein.

DETAILED DESCRIPTION

Figure 1A:
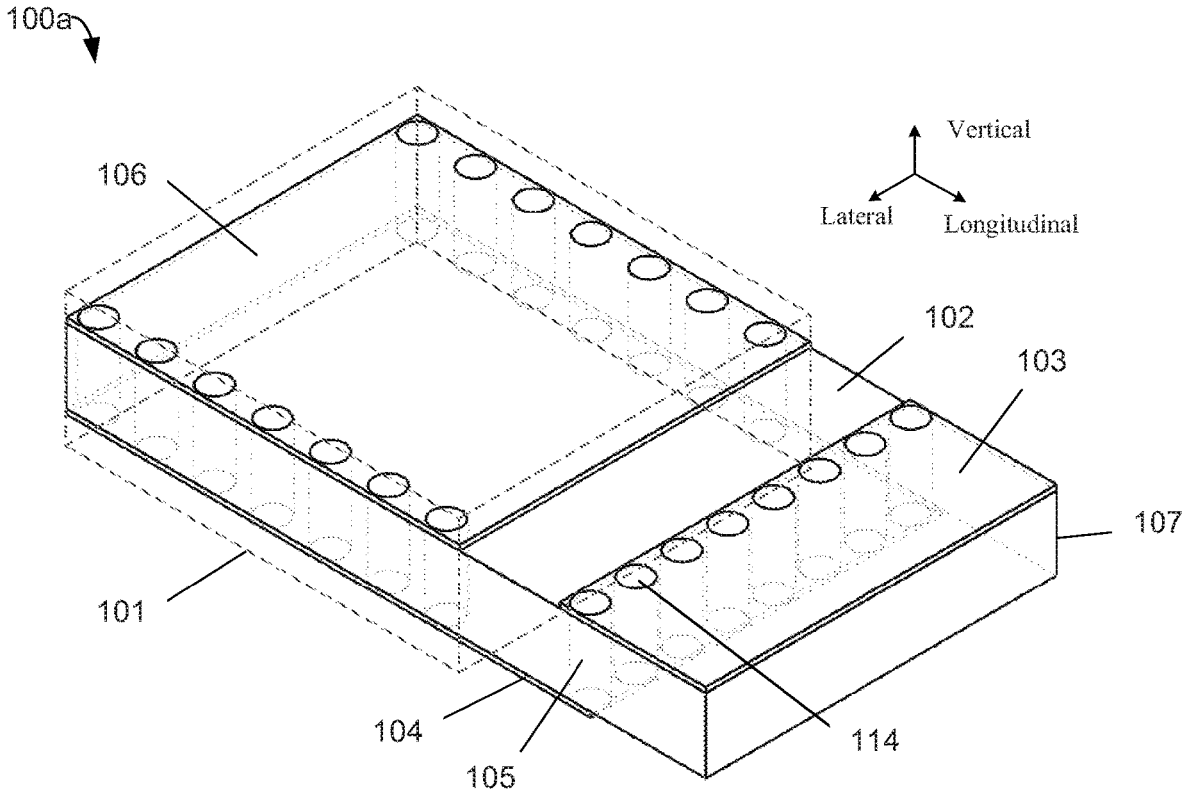
FIG. 1(*a*) illustrates a perspective view of an example antenna, in accordance with one or more embodiments described herein.
Figure 1B:
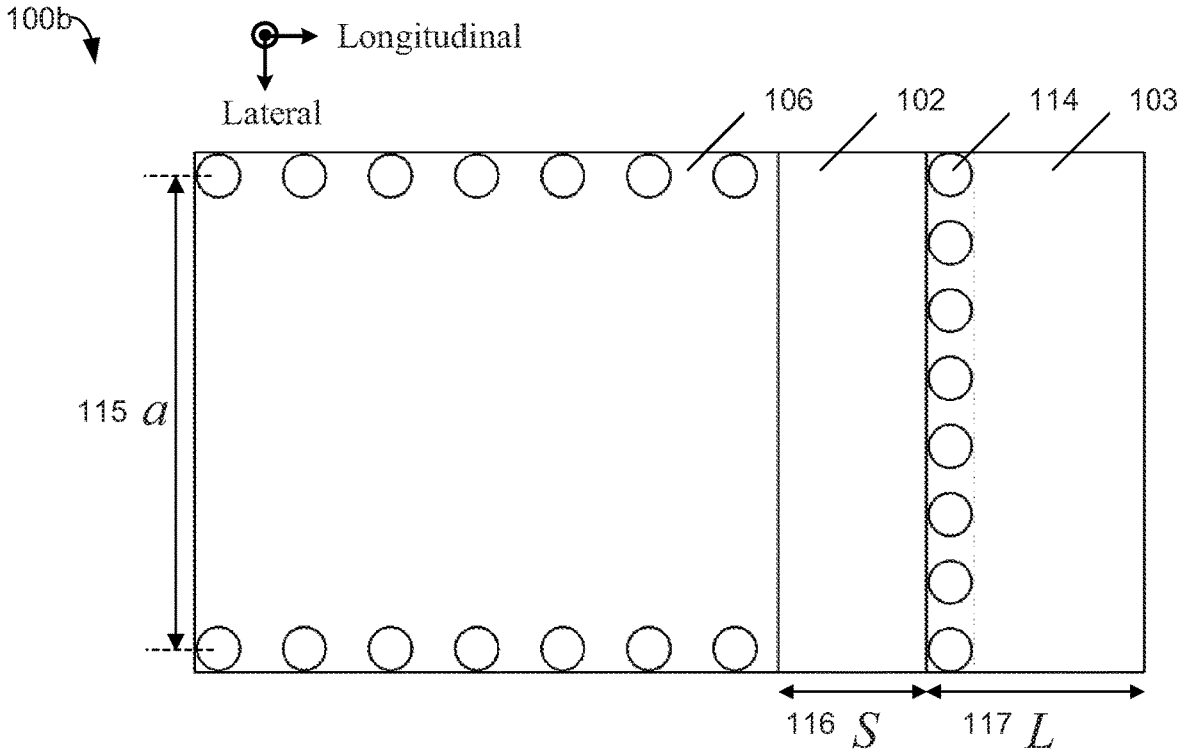
Figure 1C:
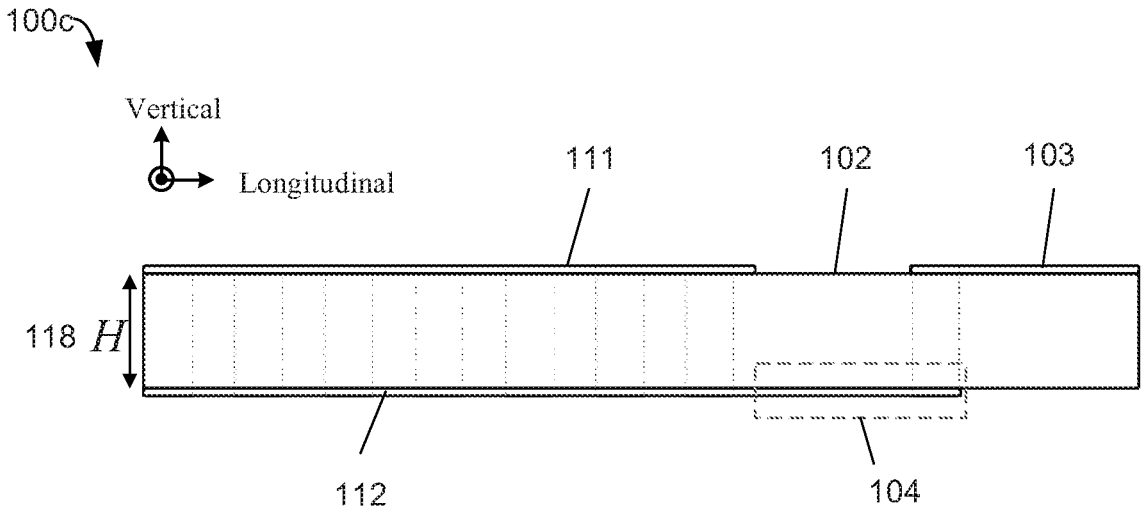
Figure 1D:
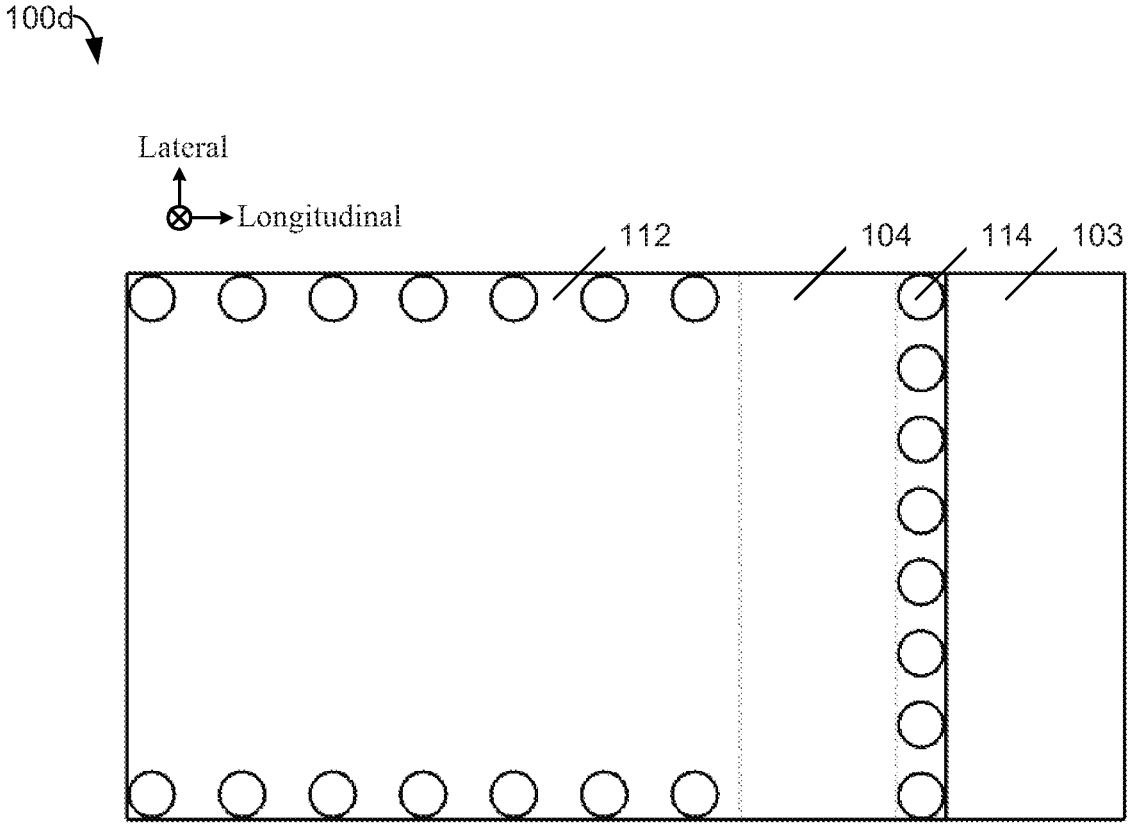

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Compared with a narrowband antenna, a wideband antenna can serve multiple applications at different frequency bands simultaneously, and can support broadband systems with high data transmission rates. In addition, antennas with a simple structure can reduce the difficulty and cost of processing, which can be especially attractive for millimeter-wave applications.

In the prior art, a slot antenna is a kind of antenna with simple structure. It can be used for millimeter-wave applications because such an antenna can be conveniently processed using a low-cost printed circuit board (PCB) technology. However, the main drawback of the slot antenna is that its bandwidth is narrow.

To these and/or related ends, various embodiments disclosed herein provide for an improved waveguide fed open slot antenna that achieves a wide bandwidth based on the simple structure of the slot antenna. In embodiments, and in contrast to the traditional slot antenna, only two sides of the slot (sometimes referred to as an "open slot") are connected to metal, whereas the other two sides are open (i.e., not connected to metal), and the waveguide is used to feed the slot. These approaches can be applied to both the traditional microwave frequency band and the millimeter wave frequency band, and can be utilized as an element of an antenna array.

Compared with a conventional waveguide slot antenna, in embodiments, two long sides of a slot of a waveguide fed open slot antenna have metal boundaries, while two short sides do not have metal boundaries—i.e., it is an open structure. In order to excite the slot, one long side of the slot can be connected to, the top surface of the waveguide section, and the other long side can be connected to, the waveguide bottom extension (sometimes referred to as a "waveguide extension") by the vertical metal wall (sometimes referred to as a "metal wall"). A wide bandwidth and a stable gain can be achieved by selecting an appropriate waveguide height, H, and adjusting the length of the short side of the slot, S. A matching load with appropriate length can help to further expand the bandwidth and make the patterns more symmetrical. The antenna can be used as an element in antenna arrays.

To the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

It is to be appreciated that the term "substantially" in conjunction with another term as used herein is intended to refer an attempt to achieve a desired outcome associated with the other term while being within an acceptable tolerance of the desired outcome. For example, "substantially equal" can equate to "equal" with an acceptable tolerance, such as manufacturing variances when attempting to achieve "equal" may be within acceptable tolerances while not being exactly "equal."

Further, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

It can be understood that, herein, the terms "longitudinal," "lateral," and "vertical" are used for convenience and clarity of description and are based on the ground plane occupying a horizontal plane. The use of these and similar terms, such as "top," "bottom," and "upper" should not be taken as implying any limitation on the orientation of the antenna. Furthermore, it can be appreciated that terms such as a first side of an object and a second side of the object can be used to refer to a top and bottom of the object, respectively, and that a similar approach can be used to describe other portions of various objects.

Referring now to FIGS. 1(*a*)-(*d*), these Figures illustrate various views of an example antenna, in accordance with one or more embodiments described herein. More specifically, FIG. 1(*a*) illustrates a perspective view 100*a* of the example antenna; FIG. 1(*b*) illustrates a top view 100*b* of the example antenna; FIG. 1(*c*) illustrates a side view 100*c* of the example antenna; and FIG. 1(*d*) illustrates a bottom view 100*d* of the example antenna.

In the example of FIGS. 1(*a*)-(*d*), the example antenna comprises a waveguide section 101, a slot 102, a matching load 103, a waveguide bottom extension 104, a vertical metal wall 105, an antenna excitation port 106, and a dielectric substrate 107. In the example of FIGS. 1(*a*)-(*d*), the waveguide section 101 is a SIW and the matching load 103 is a piece of metal patch. The top metal wall 111 of the SIW, the slot 102, and the matching load 103, can be located on an upper surface of the dielectric substrate 107. Then, the slot 102 can be rectangular, and one of its long sides (which can be relative to what can be a shorter side of the rectangular shape) can connect to the top surface of the SIW 111 (e.g., the waveguide section), while another long side can connect to the matching load 103. Then, the two short sides of the slot 102 are depicted in this example as not being connected to any metal. Furthermore, the top surface of the SIW 111, the slot 102 and the matching load 103 can have the same width in the lateral direction, and they can be arranged along the longitudinal direction.

In one or more embodiments, a waveguide fed open slot antenna comprises the waveguide section 101, the slot 102, the matching load 103, the waveguide bottom extension 104, and the vertical metal wall 105.

The antenna excitation port 106 can be the port of the waveguide section 101 that is positioned away from the slot 102. The vertical metal wall 105 can be constructed by a row of metalized vias. The width of the vertical metal wall 105 (in the lateral direction) and the width (in the lateral direction) of the slot 102 can be equal in the lateral direction. The top end of the vertical metal wall 105 can be connected to the edge of the matching load 103, which is close to the slot 102.

The waveguide bottom extension 104 can be rectangular, and can be formed by extending the bottom metal wall of the waveguide section 112 along the longitudinal direction. An end of the waveguide bottom extension 104 can connect to the bottom end of the vertical metal wall 105. The height (in the vertical direction) of the vertical metal wall 105 can be equal to the height (in the vertical direction) of the waveguide section 101. The antenna can be processed by PCB technology.

The width a 115 of the waveguide section can ensure that the waveguide operates in a transverse electric 10 ($TE_{10}$) mode. In order to achieve impedance matching in a wide frequency band, the height H 118 of the waveguide section can be utilized as a parameter. For example, a Rogers Duroid 5880 high frequency laminate with a thickness of 0.508 millimeters (mm), and a dielectric constant of 2.2 can be selected as the dielectric substrate, with a thickness of about 0.19λ (where λ represents the dielectric wavelength at the operating center frequency). The width S 116 of the slot is another parameter that can affect the impedance matching, which is about 0.26λ in this example. The matching load can further expand the bandwidth, and the matching load can take the form of a rectangular patch with a width L 117 of about 0.37λ.

Example dimensions (in mm) for the antenna structure in FIGS. 1(*a*)-(*d*) are given below in the event of an operating center frequency of 75 GHz.

| H 118 | α 115 | S 116 | L 117 |
|---|---|---|---|
| 0.508 | 2.2 | 0.8 | 1 |

The width (in the lateral direction) of the vertical metal wall 105 can be equal to that of the slot 102, and the height (in the vertical direction) of the vertical metal wall 105 can be equal to that of the waveguide section 101. The top of the vertical metal wall 105 can be connected to an edge of the matching load 103 on the side close to the slot 102. The bottom of the metal wall 105 can be connected to an edge of the waveguide bottom extension 104.

In one or more alternative embodiments, the waveguide section 101 can be a SIW, and the entire antenna can be built on a dielectric substrate 107, where the vertical metal wall 105 can be constructed with a row of metalized vias 114. A metalized via is generally a metal structure that connects two metal layers in an electrical circuit. The matching load 103 can take many possible forms. For example, in an alternative embodiment, the matching load 103 can comprise a piece of metal patch and can be located in the same plane as the slot 102. In this embodiment, the metal patch can be rectangular, triangular, semi-circular, or polygonal.

In one or more additional alternative embodiments, the matching load 103 can include an upper metal patch, a lower metal patch, and metalized vias. The upper metal patch and the lower metal patch can have the same shape and they can overlap each other after shifted along the vertical direction. The upper metal patch and the slot 102 can be in the same plane, and the lower metal patch and the waveguide bottom extension 104 can be in the same plane. An edge of the upper metal patch can be connected with an edge of the lower metal patch by the metalized vias. In this embodiment, the metal patches can be rectangular, triangular, semi-circular, or polygonal.

In one or more additional alternative embodiments, the waveguide section can be a rectangular waveguide, where the matching load 103 can take many possible forms. For example, in an alternative embodiment, the matching load 103 can be a piece of metal patch and can be in the same plane as the slot 102. In this embodiment, the metal patch can be rectangular, triangular, semi-circular, or polygonal. In another alternative embodiment, the matching load 103 can be a metal block. The top and bottom surfaces of the metal block can have the same shape and they can overlap each other after shifted along the vertical direction. The top surface of the metal block and the slot 102 can be in the same plane, and the bottom surface of the metal block and the waveguide bottom extension 104 can be in the same plane. One side of the metal block that is near the slot 102 can be coincident with the vertical metal wall 105. In this embodiment, the top surface of the metal block can be rectangular, triangular, semi-circular, or polygonal. In order to reduce the size of the antenna, the interior of the rectangular waveguide, and the space between the slot and the waveguide bottom extension can be filled with dielectric material.

The embodiment of FIG. 1 can be simulated by a commercial full-wave electromagnetic simulation software based on a Finite Element Method (FEM) numerical method. Results from such an example simulation are shown in FIGS. 2 and 3.

Figure 2:
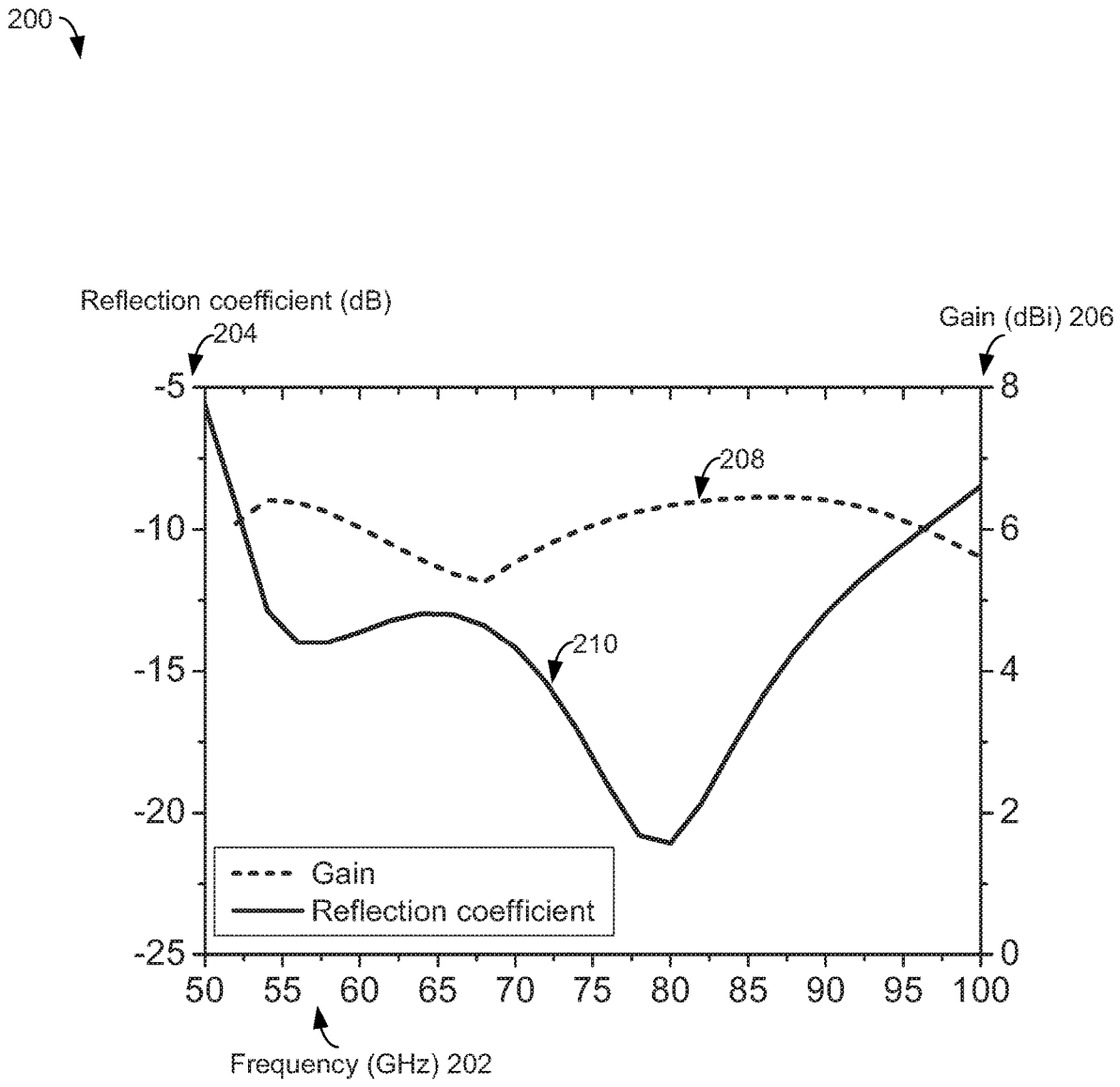
FIG. 2 illustrates a graph of simulated reflection coefficient and gain versus frequency for the antenna of FIG. 1(*a*), in accordance with one or more embodiments described herein.

FIG. 2 illustrates a graph 200 of simulated reflection coefficient and gain versus frequency for the antenna of FIG. 1(*a*), in accordance with one or more embodiments described herein. As depicted, a reflection coefficient (in decibels (dB)) 204 is plotted 210 against frequency (in GHz) 202. Likewise, a gain (in decibel(isotropic) (dBi)) 206 is plotted 208 against frequency 202. It can be seen that, as depicted, in the frequency range of 52.5-96.3 GHz, the reflection coefficient of the antenna is lower than −10 dB. That is, the antenna achieves a wide impedance bandwidth of 58.8%. As depicted, the gain varies between 5.2 to 6.4 dBi within the operating band.

Figure 3A:
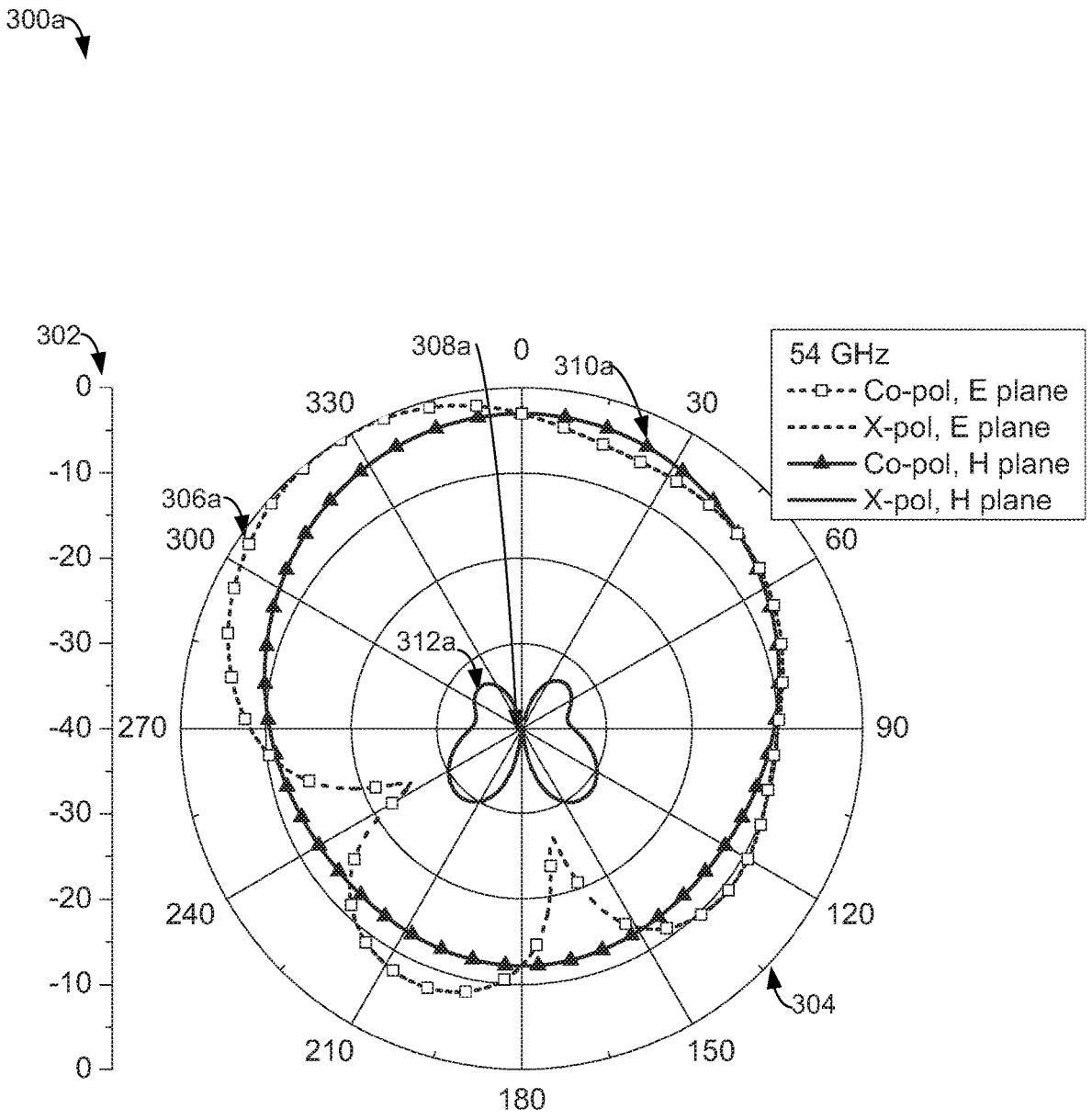
FIG. 3(*a*) illustrates a graph of simulated radiation patterns for the antenna of FIG. 1(*a*) at 54 gigahertz (GHz), in accordance with one or more embodiments described herein.
Figure 3B:
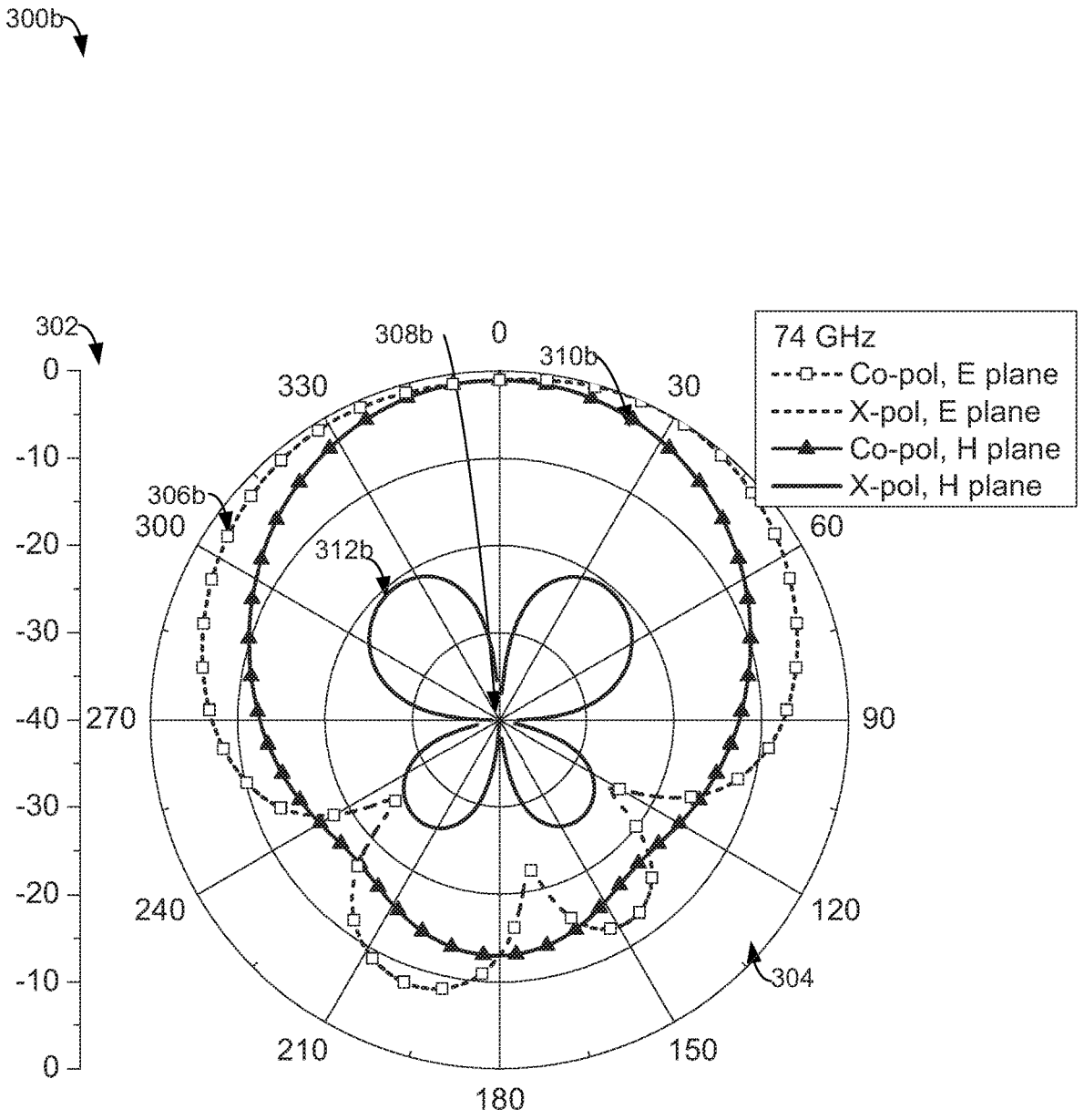
Figure 3C:
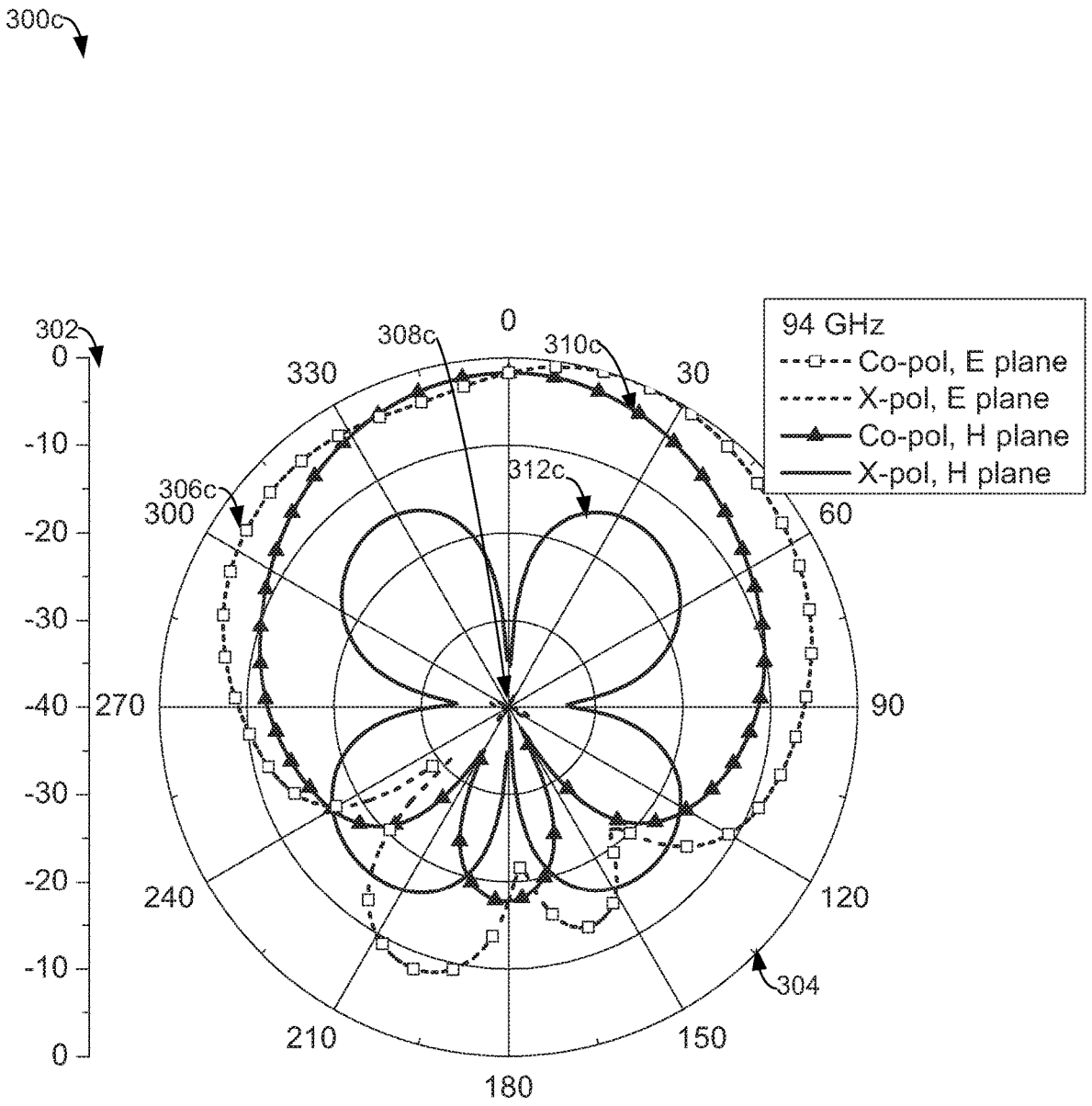

FIGS. 3(*a*)-(*c*) show the radiation patterns at 54 GHz, 74 GHz, and 94 GHz, respectively. It can be seen that stable radiation patterns are achieved over the whole operating frequency band.

FIG. 3(*a*) illustrates a graph of simulated radiation patterns 300*a* for the antenna of FIG. 1(*a*) at 54 GHz, in accordance with one or more embodiments described herein. Simulated radiation patterns 300*a* are plotted on polar coordinates 304 along with a normalized gain (in dBi) 302. Four radiation patterns are plotted: co-polarization (Co-pol) in the E plane 306*a*, cross-polarization (X-pol) in the E plane 308*a*, Co-pol in the H plane 310*a*, and X-pol in the H plane 312*a*. As used herein, E plane can refer to a plane containing an electric field vector and the corresponding direction of maximum radiation. As used herein, H plane can refer to a plane containing a magnetic field vector and the corresponding direction of maximum radiation.

FIG. 3(*b*) illustrates a graph of simulated radiation patterns 300*b* for the antenna of FIG. 1(*a*) at 74 GHz, in accordance with one or more embodiments described herein. In simulated radiation patterns 300*b*, four radiation patterns are plotted: co-polarization (Co-pol) in the E plane 306*b*, cross-polarization (X-pol) in the E plane 308*b*, Co-pol in the H plane 310*b*, and X-pol in the H plane 312*b*.

FIG. 3(*c*) illustrates a graph of simulated radiation patterns 300*c* for the antenna of FIG. 1(*a*) at 94 GHz, in accordance with one or more embodiments described herein. In simulated radiation patterns 300*c*, four radiation patterns are plotted: co-polarization (Co-pol) in the E plane 306*c*, cross-polarization (X-pol) in the E plane 308*c*, Co-pol in the H plane 310*c*, and X-pol in the H plane 312*c*.

Figure 4A:
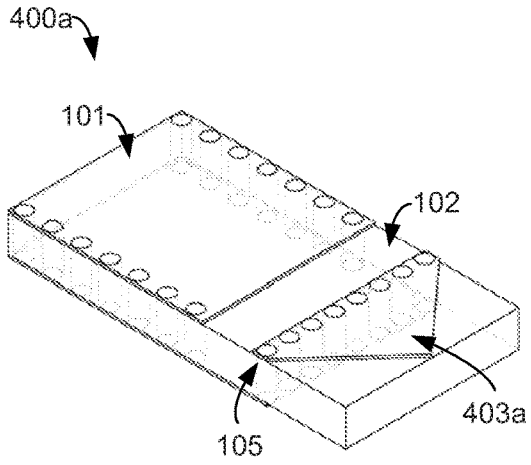
FIG. 4(*a*) illustrates an example antenna that utilizes a substrate-integrated waveguide (SIW) as a waveguide section with a triangular metal patch as the matching load, in accordance with one or more embodiments described herein.
Figure 4B:
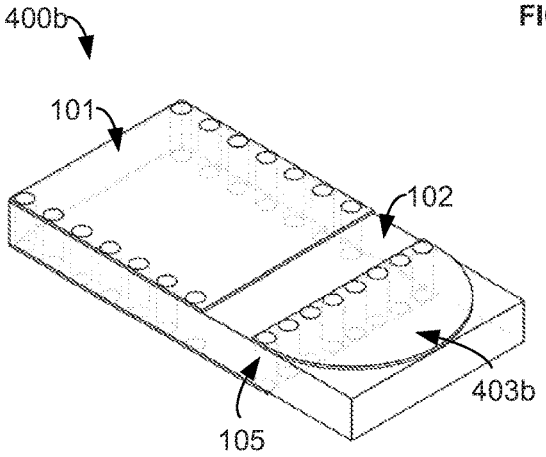
Figure 4C:
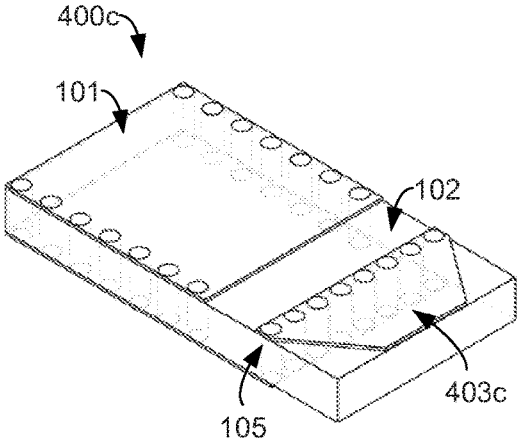
Figure 5A:
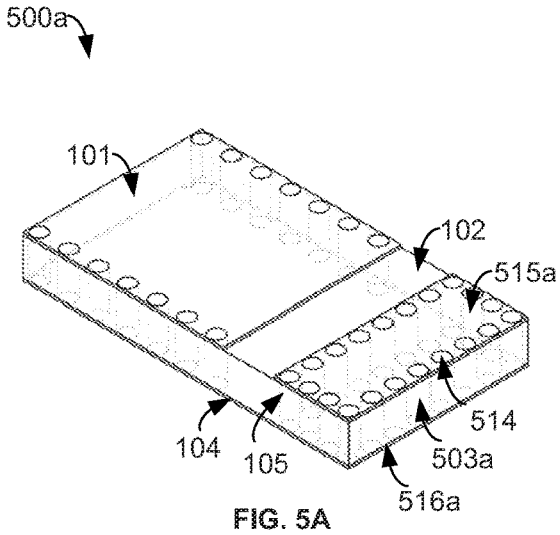
FIG. 5(*a*) illustrates an example antenna that utilizes a SIW as the waveguide section, with the matching load comprising an upper metal patch, a bottom metal patch, and metalized vias, and where the metal patches are rectangular, in accordance with one or more embodiments described herein.
Figure 5B:
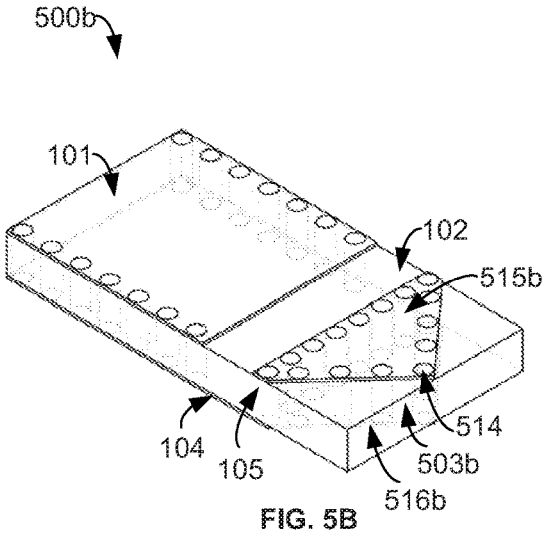
Figure 5C:
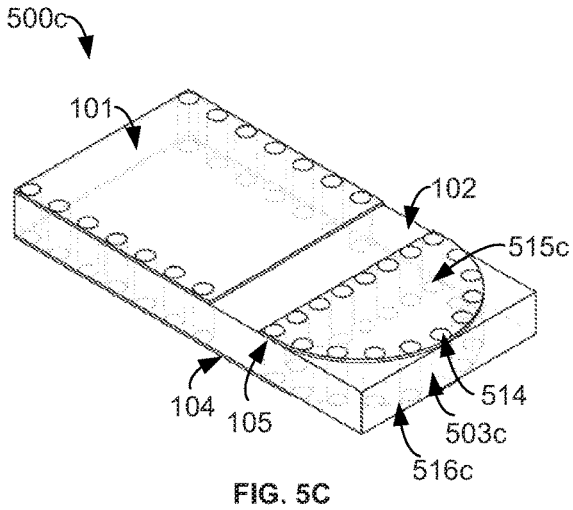
Figure 5D:
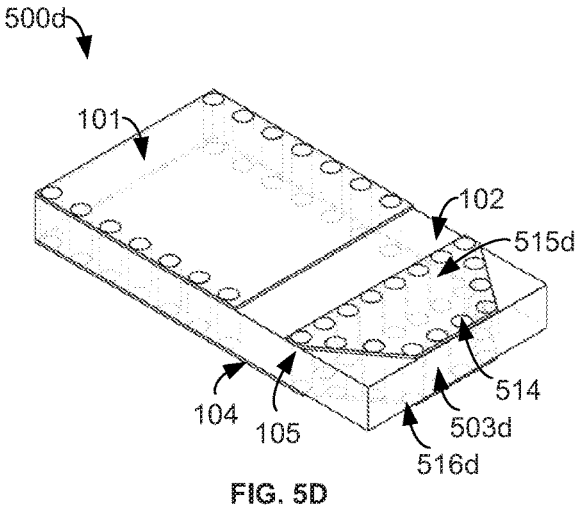
Figure 6A:
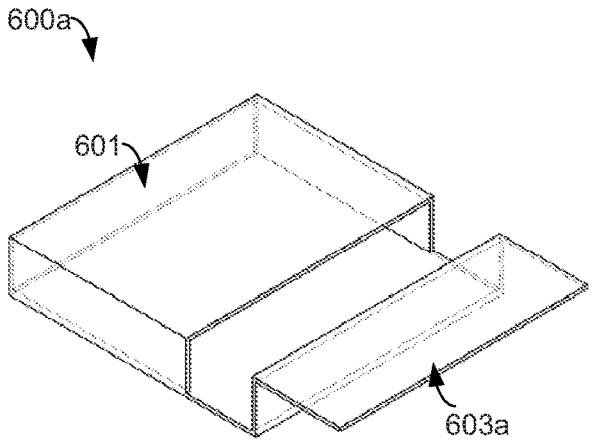
FIG. 6(*a*) illustrates an example antenna that utilizes a rectangular waveguide as the waveguide section with a rectangular metal patch as the matching load, in accordance with one or more embodiments described herein.
Figure 6B:
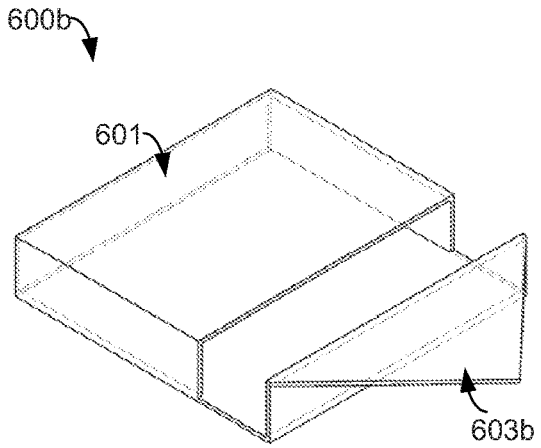
Figure 6C:
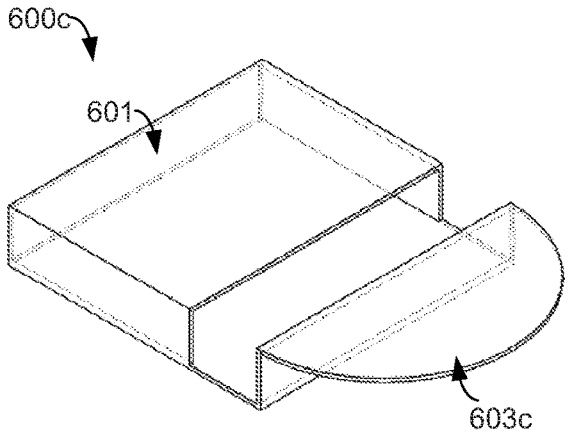
Figure 6D:
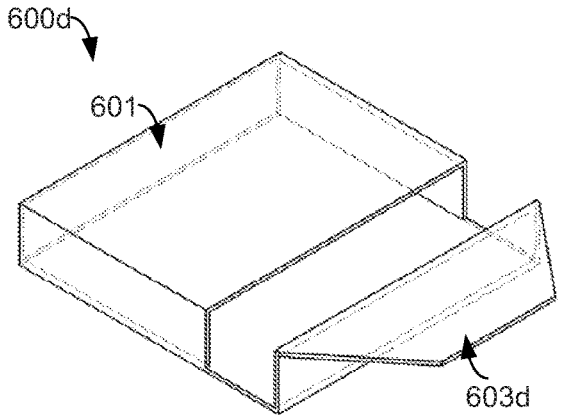
Figure 7A:
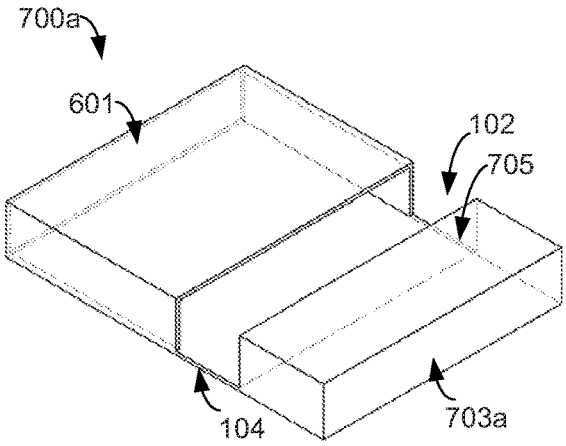
FIG. 7(*a*) illustrates an example antenna that utilizes a rectangular waveguide as the waveguide section with a rectangular metal block as the matching load, in accordance with one or more embodiments described herein.
Figure 7B:
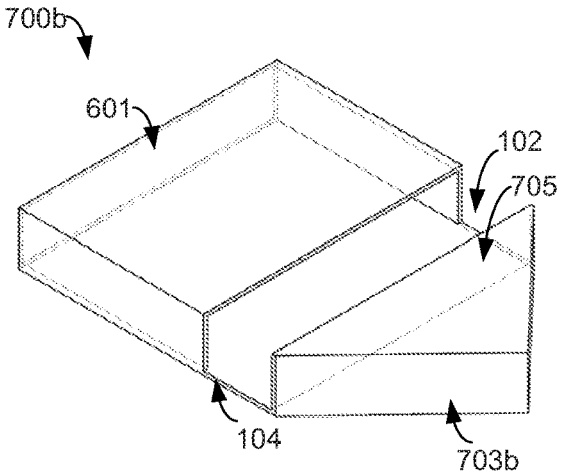
Figure 7C:
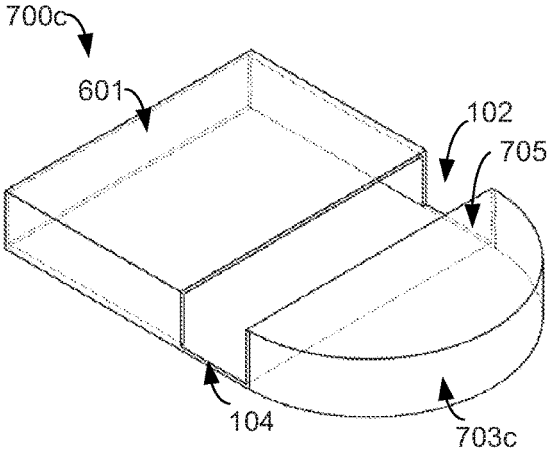
Figure 7D:
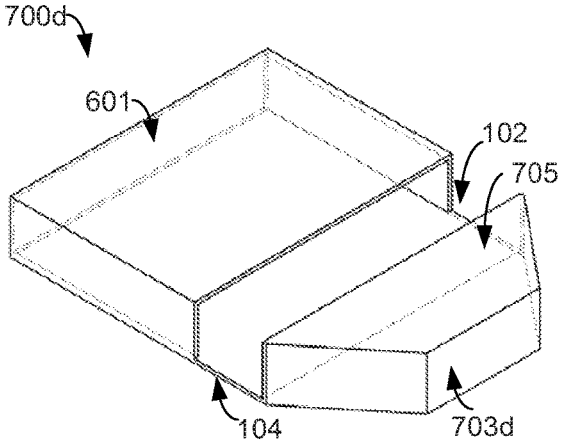

The matching load for the antenna can take many different forms other than the rectangular metal patch shown in FIG. 1. FIGS. 4(*a*)-(*c*) and 5(*a*)-(*d*) depict various forms of matching loads.

FIG. 4(*a*) illustrates an example antenna 400*a* that adopts a SIW as a waveguide section 101 with a triangular metal patch as the matching load 403*a*, in accordance with one or more embodiments described herein.

FIG. 4(*b*) illustrates an example antenna 400*b* that adopts a SIW as a waveguide section 101 with a semi-circular metal patch as the matching load 403*b*, in accordance with one or more embodiments described herein.

FIG. 4(*c*) illustrates an example antenna 400*c* that utilizes a SIW as a waveguide section 101 with a polygonal metal patch as the matching load 403*c*, in accordance with one or more embodiments described herein.

FIG. 5(*a*) illustrates an example antenna 500*a* that utilizes a SIW as the waveguide section 101, with the matching load 503*a* comprising an upper metal patch 515*a*, a bottom metal patch 516*a*, and metalized vias 514, and where the metal patches are rectangular, in accordance with one or more embodiments described herein. The upper metal patch 515*a* and the lower metal patch 516*a* can have the same shape, and they can overlap each other after shifted along the vertical direction. The upper metal patch 515*a* and the slot 102 are positioned coplanar. The lower metal patch 516*a* and the waveguide bottom extension 104 are positioned coplanar. An edge of the upper metal patch 515*a* is connected with an edge of the lower metal patch 516*a* by the metalized vias 514.

FIG. 5(*b*) illustrates an example antenna 500*b* that utilizes a SIW as the waveguide section 101, with the matching load 503*b* comprising an upper metal patch 515*b*, a bottom metal patch 516*b*, and metalized vias 514, and where the metal patches are triangular, in accordance with one or more embodiments described herein. The upper metal patch 515*b* and the lower metal patch 516*b* can have the same shape, and they can overlap each other after shifted along the vertical direction. The upper metal patch 515*b* and the slot 102 are positioned coplanar. The lower metal patch 516*b* and the waveguide bottom extension 104 are positioned coplanar. An edge of the upper metal patch 515*b* is connected with an edge of the lower metal patch 516*b* by the metalized vias 514.

FIG. 5(*c*) illustrates an example antenna 500*c* that utilizes a SIW as the waveguide section 101, with the matching load 503*c* comprising an upper metal patch 515*c*, a bottom metal patch 516*c*, and metalized vias 514, and where the metal patches are semi-circular, in accordance with one or more embodiments described herein. The upper metal patch 515*c* and the lower metal patch 516*c* can have the same shape, and they can overlap each other after shifted along the vertical direction. The upper metal patch 515*c* and the slot 102 are positioned coplanar. The lower metal patch 516*c* and the waveguide bottom extension 104 are positioned coplanar. An edge of the upper metal patch 515*c* is connected with an edge of the lower metal patch 516*c* by the metalized vias 514.

FIG. 5(*d*) illustrates an example antenna 500*d* that utilizes a SIW as the waveguide section 101, with the matching load 503*d* comprising an upper metal patch 515*d*, a bottom metal patch 516*d*, and metalized vias 514, and where the metal patches are polygonal, in accordance with one or more embodiments described herein. The upper metal patch 515*d* and the lower metal patch 516*d* can have the same shape, and they can overlap each other after shifted along the vertical direction. The upper metal patch 515*d* and the slot 102 are positioned coplanar. The lower metal patch 516*d* and the waveguide bottom extension 104 are positioned coplanar. An edge of the upper metal patch 515*d* is connected with an edge of the lower metal patch 516*d* by the metalized vias 514.

The waveguide section of the antenna can also adopt a rectangular waveguide, while the antenna has a metal structure as a whole, as shown in FIGS. 6(*a*)-(*d*) and 7(*a*)-(*d*). It can be appreciated that the various shapes depicted in FIGS. 6(*a*)-(*d*) and 7(*a*)-(*d*) are examples, and there can be antennas according to the present disclosure that are implemented utilizing different shapes.

FIG. 6(*a*) illustrates an example antenna 600*a* that utilizes a rectangular waveguide as the waveguide section 601 with a rectangular metal patch as the matching load 603*a*, in accordance with one or more embodiments described herein. Here, matching load 603*a* comprises a rectangular metal patch that is positioned coplanar with slot 102.

FIG. 6(*b*) illustrates an example antenna 600*b* that utilizes a rectangular waveguide as the waveguide section 601 with a triangular metal patch as the matching load 603*b*, in accordance with one or more embodiments described herein. Here, matching load 603*b* comprises a triangular metal patch that is positioned coplanar with slot 102.

FIG. 6(*c*) illustrates an example antenna 600*c* that utilizes a rectangular waveguide as the waveguide section 601 with a semi-circular metal patch as the matching load 603*c*, in accordance with one or more embodiments described herein. Here, matching load 603*c* comprises a semi-circular metal patch that is positioned coplanar with slot 102.

FIG. 6(*d*) illustrates an example antenna 600*d* that utilizes a rectangular waveguide as the waveguide section 601 with a polygonal metal patch as the matching load 603*d*, in accordance with one or more embodiments described herein. Here, matching load 603*d* comprises a polygonal metal patch that is positioned coplanar with slot 102.

FIG. 7(*a*) illustrates an example antenna 700*a* that utilizes a rectangular waveguide as the waveguide section 601 with a rectangular metal block as the matching load 703*a*, in accordance with one or more embodiments described herein. Matching load 703*a* is a rectangular metal block whose top and bottom surfaces have the same shape and can overlap each other after shifted in the vertical direction. The top surface of matching load 703*a* and slot 102 are positioned coplanar. The bottom surface of matching load 703*a* and waveguide bottom extension 104 are positioned coplanar. One side of matching load 703*a* that is near slot 102 is coincident with vertical metal wall 705.

FIG. 7(*b*) illustrates an example antenna 700*b* that utilizes a rectangular waveguide as the waveguide section 601 with a triangular metal block as the matching load 703*b*, in accordance with one or more embodiments described herein. Matching load 703*b* is a triangular metal block whose top and bottom surfaces have the same shape and can overlap each other after shifted in the vertical direction. The top surface of matching load 703*b* and slot 102 are positioned coplanar. The bottom surface of matching load 703*b* and waveguide bottom extension 104 are positioned coplanar. One side of matching load 703*b* that is near slot 102 is coincident with vertical metal wall 705.

FIG. 7(*c*) illustrates an example antenna 700*c* that utilizes a rectangular waveguide as the waveguide section 601 with a semi-circular metal block as the matching load 703*c*, in accordance with one or more embodiments described herein. Matching load 703*c* is a semi-circular metal block whose top and bottom surfaces have the same shape and can overlap each other after shifted in the vertical direction. The top surface of matching load 703*c* and slot 102 are positioned coplanar. The bottom surface of matching load 703*c* and waveguide bottom extension 104 are positioned coplanar. One side of matching load 703*c* that is near slot 102 is coincident with vertical metal wall 705.

FIG. 7(*d*) illustrates an example antenna 700*d* that utilizes a rectangular waveguide as the waveguide section 601 with a polygonal metal block as the matching load 703*d*, in accordance with one or more embodiments described herein. Matching load 703*d* is a polygonal metal block whose top and bottom surfaces have the same shape and can overlap each other after shifted in the vertical direction. The top surface of matching load 703*d* and slot 102 are positioned coplanar. The bottom surface of matching load 703*d* and waveguide bottom extension 104 are positioned coplanar. One side of matching load 703*d* that is near slot 102 is coincident with vertical metal wall 705.

In order to reduce antenna size, in FIGS. 6(*a*)-(*d*) and 7(*a*)-(*d*), the interior of the waveguide section (e.g., waveguide section 601 of FIG. 6(*a*)), and the space between the slot and the waveguide bottom extension (e.g., between slot 102 and waveguide bottom extension 104 of FIG. 7(*a*)), can be filled with dielectric material.

Figure 8:
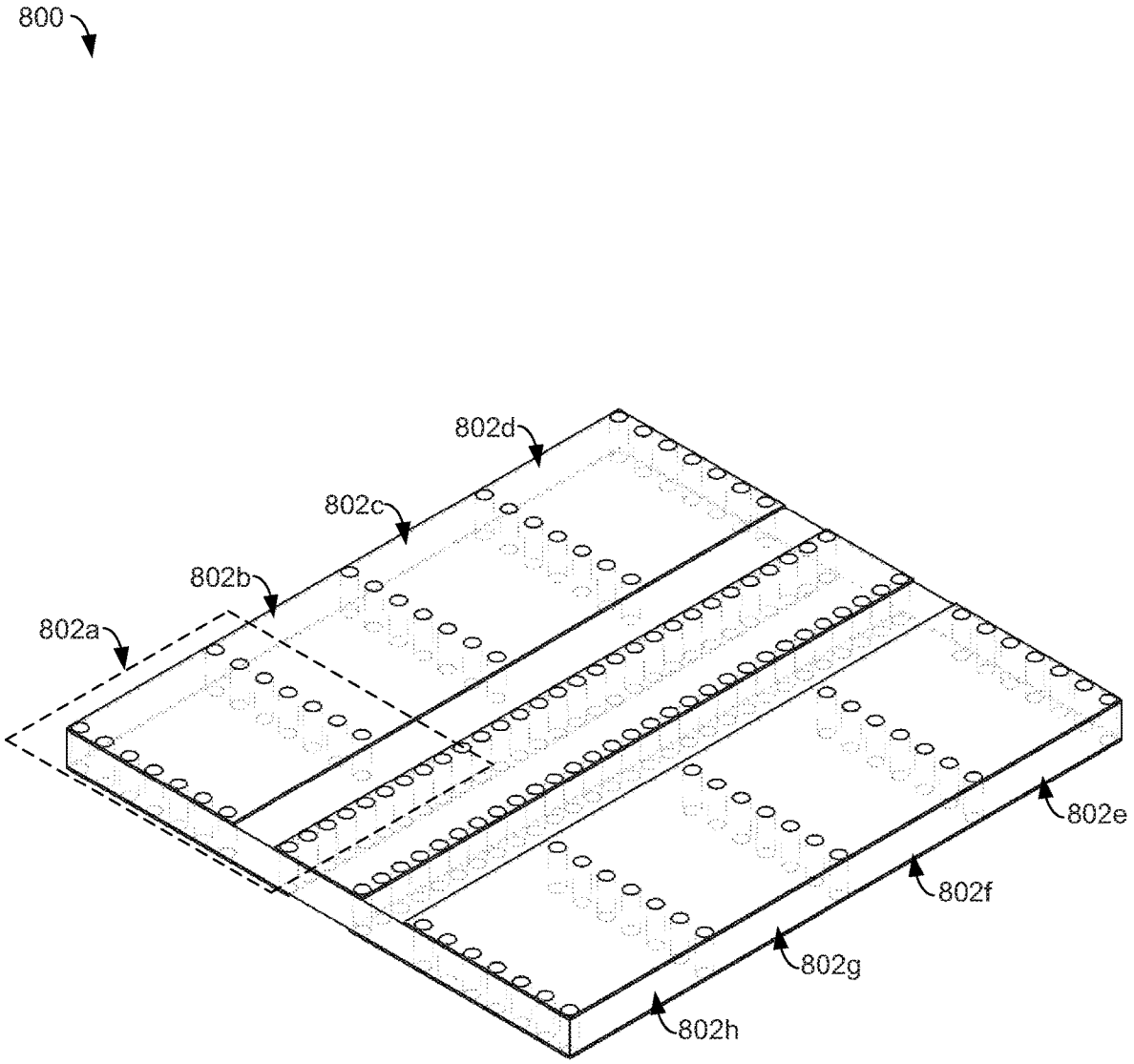
FIG. 8 illustrates an example antenna array, in accordance with one more embodiments described herein.

An antenna such as described herein can be used as a basic element to construct an antenna array. FIG. 8 illustrates an example antenna array 800, in accordance with one more embodiments described herein. As depicted, antenna array 800 is composed of eight antennas as described herein. The eight antennas depicted in antenna array 800 are depicted as antenna 802*a*, antenna 802*b*, antenna 802*c*, antenna 802*d*, antenna 802*e*, antenna 802*f*, antenna 802*g*, and antenna 802*h*. As depicted, each of antennas 802*a-h* adopts a SIW as a waveguide section. It will can be appreciated that there can be embodiments of antenna arrays that utilize more or fewer than eight antennas, use one or more different antenna types, and/or arrange antennas in a different configuration than is depicted in FIG. 8.

An antenna in accordance with embodiments of the present disclosure can provide for excellent performance (such as wide bandwidth), a simple structure, and a low fabrication cost. The wide bandwidth provided by such an antenna can make it highly attractive for the development of various kinds of indoor and outdoor base station antennas for modern cellular communication systems, since this wide bandwidth can cover multiple frequency bands of different applications. In addition, the antenna can have a simple structure, and can be fabricated with a low-cost PCB technology for millimeter-wave applications. Additionally, the antenna can also be used as a basic element in the design of a low-cost and high-performance antenna array with different gain and beam widths.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An antenna, comprising:

a waveguide section positioned on a first side of a slot in the antenna;

a matching load positioned on a second side of the slot in the antenna;

a waveguide extension that extends a surface of the waveguide section and connects with the matching load, the slot being separate from the waveguide extension; and a metal wall that connects the waveguide extension and the matching load.

2. The antenna of claim 1, wherein the metal wall comprises a first dimension with a first length and a second dimension with a second length, wherein the first dimension of the first length of the metal wall is equal to a third dimension of a third length of the slot, and wherein a second dimension of a second length of the metal wall is equal to a fourth dimension of a fourth length of the waveguide section.

3. The antenna of claim 2, wherein the waveguide extension is rectangular, and an edge of the waveguide bottom extension connects to an edge of the metal wall.

4. The antenna of claim 1, wherein the waveguide section comprises a substrate-integrated waveguide (SIW), and wherein the antenna is built on a dielectric substrate.

5. The antenna of claim 4, wherein the metal wall comprises a row of metalized vias.

6. The antenna of claim 1, wherein the waveguide section comprises a rectangular waveguide.

7. The antenna of claim 6, wherein an interior of the rectangular waveguide, and a space between the slot and the waveguide extension are substantially filled with a dielectric material.

8. The antenna of claim 1, wherein the matching load comprises a piece of metal patch comprising a semi-circular shape.

9. The antenna of claim 1, wherein the matching load comprises a piece of metal patch comprising a triangular shape or a trapezoidal shape.

10. The antenna of claim 8, wherein the metal patch and the slot are coplanar.

11. A system, comprising:

a waveguide section positioned on a first side of a slot in the antenna;

a matching load positioned on a second side of the slot in the antenna; and a waveguide extension that extends a surface of the waveguide section and connects with the matching load, the waveguide extension being separate from the slot.

12. The system of claim 11, wherein the matching load comprises a first metal patch, a second metal patch, and a group of metalized vias.

13. The system of claim 12, wherein the first metal patch and the second metal patch have a same shape.

14. The system of claim 12, wherein the first metal patch and the slot are coplanar, and wherein the second metal patch and the waveguide extension are coplanar.

15. The system of claim 12, wherein an edge of the first metal patch is connected with an edge of the second metal patch by the group of metalized vias.

16. The system of claim 11, wherein the matching load comprises a metal block.

17. The system of claim 16, wherein a first surface of the metal block has a triangular shape or a semi-circular shape.

18. The system of claim 16, wherein a first surface of the metal block and a second surface of the metal block have a same shape.

19. The system of claim 16, wherein a first surface of the metal block and the slot are coplanar, and wherein a second surface of the metal block and the waveguide extension are coplanar.

20. The system of claim 16, wherein a first side of the metal block that is located proximal to the slot is coincident with a metal wall.

21. A device, comprising:

a waveguide section positioned on a first side of a slot in the device;

a matching load positioned on a second side of the slot;

a waveguide extension that extends a surface of the waveguide section across the slot and connects with the matching load, the slot being separate from the waveguide extension; and a metal wall that connects a first side of the waveguide extension that is away from the waveguide section with a first side of the matching load that is located proximal to the slot.

22. The device of claim 21, wherein the antenna is arranged as an antenna element of antenna elements in an antenna array.

23. The device of claim 21, wherein the slot is rectangular and comprises a first long side and a second long side, wherein the first long side of the slot abuts the waveguide section, wherein the second long side abuts the matching load, and wherein the slot comprises a first short side and a second short side that do not abut any metal.

24. The device of claim 21, wherein a first surface of the waveguide section, the slot, and the matching load have a same width in a first direction; and wherein the first surface of the waveguide section, the slot, and the matching load are arranged along a second direction.

25. The device of claim 21, further comprising:

a port of the waveguide section located away from the slot that is used as an antenna excitation port.

26. The device of claim 21, wherein a first edge of the metal wall is connected to a first edge of the matching load on a first side of the matching load located proximal to the slot, without connecting to a second edge of the matching load on a second side of the matching load located distal from the slot, and wherein a second edge of the metal wall is connected to an edge of the waveguide extension.

* * * * *